US011598584B2

(12) United States Patent
Lin

(10) Patent No.: US 11,598,584 B2
(45) Date of Patent: Mar. 7, 2023

(54) DUAL HEAT TRANSFER STRUCTURE

(71) Applicant: ASIA VITAL COMPONENTS CO., LTD., New Taipei (TW)

(72) Inventor: Sheng-Huang Lin, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 229 days.

(21) Appl. No.: 16/849,973

(22) Filed: Apr. 15, 2020

(65) Prior Publication Data

US 2021/0325120 A1 Oct. 21, 2021

(51) Int. Cl.
*F28D 15/00* (2006.01)
*F28D 15/02* (2006.01)
*F28D 15/04* (2006.01)

(52) U.S. Cl.
CPC ..... *F28D 15/0275* (2013.01); *F28D 15/0233* (2013.01); *F28D 15/0266* (2013.01); *F28D 15/046* (2013.01)

(58) Field of Classification Search
CPC ..... F28D 15/0275; F28D 15/0233; F28D 15/0266; F28D 15/046; F28D 15/0283
See application file for complete search history.

(56) References Cited

U.S. PATENT DOCUMENTS 3,677,329 A * 7/1972 Kirkpatrick ..... H05B 3/64 29/890.032
4,067,315 A * 1/1978 Fehlner ..... F24S 10/45 126/636
4,212,347 A * 7/1980 Eastman ..... F28D 15/0241 29/890.039
4,253,431 A * 3/1981 Mettig ..... F28D 15/0275 123/41.31
4,345,642 A * 8/1982 Ernst ..... F28F 13/00 165/104.19
4,760,878 A * 8/1988 Fukui ..... C23F 11/185 165/104.27

(Continued)

FOREIGN PATENT DOCUMENTS

CN 2762507 Y 3/2006
CN 201639911 U 11/2010

(Continued)

OTHER PUBLICATIONS

Search Report dated Nov. 11, 2020 issued by Taiwan Intellectual Property Office for counterpart application No. 109110605.

(Continued)

*Primary Examiner* — Travis Ruby
(74) *Attorney, Agent, or Firm* — Demian K. Jackson; Jackson IPG PLLC

(57) ABSTRACT

A dual heat transfer structure, comprising: at least a heat pipe and at least a vapor chamber; the heat pipe having a first end, an extension portion, and a second end, the first and second ends disposed at the two ends of the extension portion; the vapor chamber being concavely bent with its two ends being joined together and selectively compasses, encircles, encloses, or surrounds one of the first and second ends and extension portion. The dual heat transfer structure of the present invention is a complex structure that can both transfer heat with a large area and to the distal end of the structure.

5 Claims, 8 Drawing Sheets

(56) References Cited

U.S. PATENT DOCUMENTS 5,283,464 A * 2/1994 Murase ..... F28D 15/0275 361/689
5,408,847 A * 4/1995 Erickson ..... F28D 15/0266 62/480
5,506,032 A * 4/1996 Rowe ..... H05K 7/20336 428/116
5,560,423 A * 10/1996 Larson ..... F28D 15/0241 165/46
5,646,822 A * 7/1997 Bhatia ..... F28D 15/02 361/679.52
6,069,791 A * 5/2000 Goto ..... G06F 1/203 361/679.55
6,118,655 A * 9/2000 Mecredy, III ..... G06F 1/203 361/679.52
6,595,269 B2 * 7/2003 Mitchell ..... H01L 23/427 361/679.52
8,176,973 B2 * 5/2012 Liao ..... F28D 15/046 165/181
8,196,645 B2 * 6/2012 Lai ..... H01L 23/427 165/104.33
10,228,197 B2 * 3/2019 Cognata ..... F28F 13/00
10,932,393 B2 * 2/2021 Paavola ..... F28D 15/0208
2006/0102323 A1 * 5/2006 Ghosh ..... H01L 23/427 165/104.21
2007/0240851 A1 * 10/2007 Liu ..... F28D 15/0275 165/104.33
2007/0240852 A1 * 10/2007 Liu ..... F28D 15/0275 165/104.14
2007/0240856 A1 * 10/2007 Liu ..... F28D 15/046 165/104.26
2007/0240858 A1 * 10/2007 Hou ..... F28D 15/046 165/146
2009/0178785 A1 * 7/2009 Hassett ..... F28D 15/0275 165/104.26
2011/0297355 A1 * 12/2011 Meyer, IV ..... H01L 23/427 165/104.26
2012/0227935 A1 * 9/2012 Huang ..... B21D 41/04 29/890.032
2012/0267078 A1 * 10/2012 Wu ..... F28D 15/0275 165/104.26
2013/0333238 A1 * 12/2013 Thiyagarajan ..... F28D 20/021 165/104.21
2014/0060781 A1 * 3/2014 Jia ..... F28D 15/0275 29/890.032
2016/0193702 A1 * 7/2016 Yang ..... H01L 21/4882 29/890.054
2017/0254600 A1 * 9/2017 Sun ..... F28D 15/04
2022/0071054 A1 * 3/2022 Lee ..... F28D 15/0233

FOREIGN PATENT DOCUMENTS

| | | | |
|---|---|---|---|
| CN | 103149993 | A | 6/2013 |
| CN | 103269573 | A | 8/2013 |
| CN | 204707386 | U | 10/2015 |
| CN | 106017168 | A | 10/2016 |
| CN | 212109685 | U | 12/2020 |
| JP | S56117094 | A | 9/1981 |
| TW | 537436 | U | 6/2003 |
| TW | M345223 | U | 11/2008 |
| TW | M385912 | U | 8/2010 |
| TW | M597034 | U | 6/2020 |

OTHER PUBLICATIONS

Search Report dated Feb. 4, 2021 issued by China National Intellectual Property Administration for counterpart application No. 2020102305692.

* cited by examiner

DUAL HEAT TRANSFER STRUCTURE

BACKGROUND OF THE INVENTION

1. Field of the Invention

The present invention relates to a dual heat transfer structure, and particularly to a dual heat transfer structure that has multiple heat transferring effects by transferring heat with a large area and to the axial distal end of the structure.

2. Description of the Related Art

A vapor chamber and heat pipe are commonly used heat transfer components. A vapor chamber is a large area, two-dimensional heat transfer method for rapid, temperature equalization expansion, which is in contact with a heat source on its one surface and provided with a cooling unit such as a heat sink on the other surface to transfer the heat generated by the heat source to the heat sink and then to exchange heat with air, thereby dispersing heat.

The principle of a heat pipe is generally the same as that of the vapor chamber. The same thing is that both components transfer heat through the heat exchange of a two-phase flow. While, the difference between the heat pipe and vapor chamber is that the heat pipe transfers heat in an axial direction, which conducts heat from one end to the other end of the heat pipe and belongs to a remote heat transfer method.

Some practitioners in the field combine the vapor chamber and the heat pipe to obtain the effects of transferring heat with a large area and to the distal end of the structure. Common ways are that the heat pipe is compassed in an airtight chamber of a vapor chamber, or an airtight chamber of the heat pipe is connected to that of the vapor chamber to obtain the effect of utilizing both the vapor chamber and the heat pipe.

The ways to combine the vapor chamber and the heat pipe from the above conventional art are complicated, and the degree of vacuum is hard to control due to air leakage, thereby producing defective products. It is difficult to maintain a vacuum and prevent the vacuum from leaking, whether it is to connect the airtight chambers of the vapor chamber and the heat pipe, or insert one end of the heat pipe into the chamber of the vapor chamber. Also, incomplete phase changes between vapor and liquid due to the placement of the heat pipe into the chamber of the vapor chamber dramatically affect heat transfer efficiency. Furthermore, the functions and configurations thereof need to be customized and thus cannot be in common use, which brings inconvenience and frustration in use. Therefore, the priority for the practitioners in the field is to improve the drawbacks of conventional art.

SUMMARY OF THE INVENTION

Accordingly, for addressing the shortcomings of the prior art, the main object of the present invention is to provide a dual heat transfer structure that combines large area heat transfer from a vapor chamber and axial distal end heat transfer from a heat pipe.

To achieve the above-mentioned object, the present invention provides a dual heat transfer structure, comprising: at least a heat pipe and at least a vapor chamber;

The heat pipe having a first end, an extension portion, and a second end, the first and second ends disposed at the two ends of the extension portion; the vapor chamber being concavely bent with its two ends being joined (connected) together and selectively compasses, encircles, encloses, or surrounds one of the first and second ends and extension portion.

The dual heat transfer structure of the present invention can address the issue of poor airtightness from the conventional manufacturing techniques, and obtain the effects of temperature equalization and distal end heat transfer from both vapor chamber and heat pipe.

DETAILED DESCRIPTION OF THE PREFERRED EMBODIMENTS

The above-mentioned object and the structure and functions of the present invention are to be illustrated with reference to the preferred embodiments in the accompanying drawings.

Figure 1:
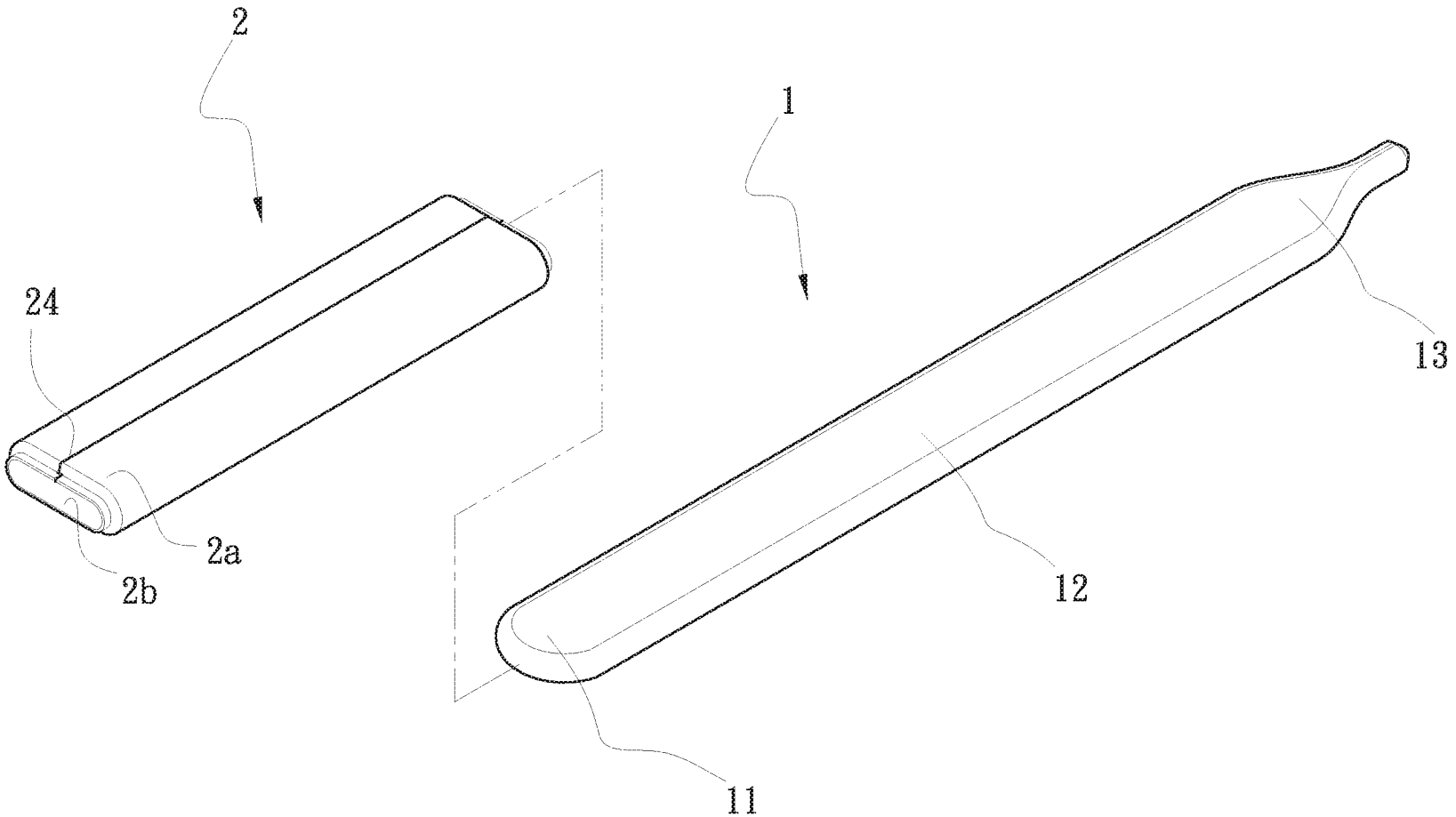
FIG. 1 is an exploded perspective view of the first embodiment of a dual heat transfer structure of the present invention.
Figure 2:
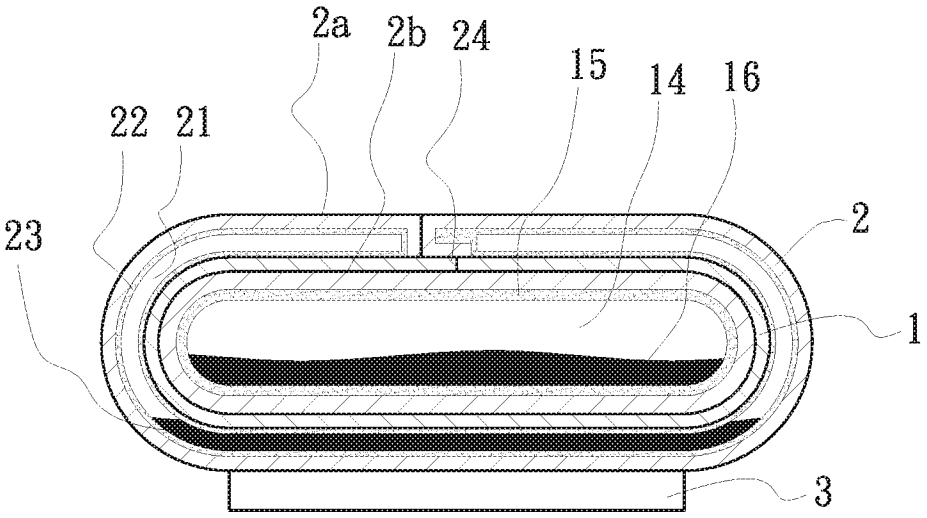
FIG. 2 is a side cross-sectional view of the first embodiment of the dual heat transfer structure of the present invention.

Referring to FIGS. 1 and 2, they are an exploded perspective view and a side cross-sectional view of the first embodiment of a dual heat transfer structure of the present invention, respectively. As shown, the dual heat transfer structure includes at least a heat pipe 1 and at least a vapor chamber 2.

The heat pipe 1 has a first end 11 and an extension portion 12, and a second end 13, in which the first and second ends 11, 13 are provided at the two ends of the extension portion 12. The heat pipe 1 is provided with a vacuum chamber 14 which is disposed independently and provided with at least a capillary wick 15 and a working fluid 16.

The vapor chamber 2 is concavely bent with its two sides being joined (connected) together and selectively compasses, encircles, encloses, or surrounds one of the first and second ends 11, 13, and extension portion 12.

The vapor chamber 2 is provided with an airtight chamber 21, the inside of which is filled with a working fluid 23. The inner wall of the airtight chamber 21 is provided with at least a capillary wick 22. The upper and lower outer surfaces of the vapor chamber 2 have a first side 2*a* and a second side 2*b*, respectively. The outer perimeter of the airtight chamber 21 has a lip side 24, two ends of which are joined together after the vapor chamber is concavely bent. The second side 2*b* is on the inner surface of the vapor chamber 2 after the vapor chamber is concavely bent. The second side 2*b* is attached to the outer perimeter of the heat pipe 1, while the first side 2*a* is in contact with a heat source 3 and transfers heat.

Figure 3:
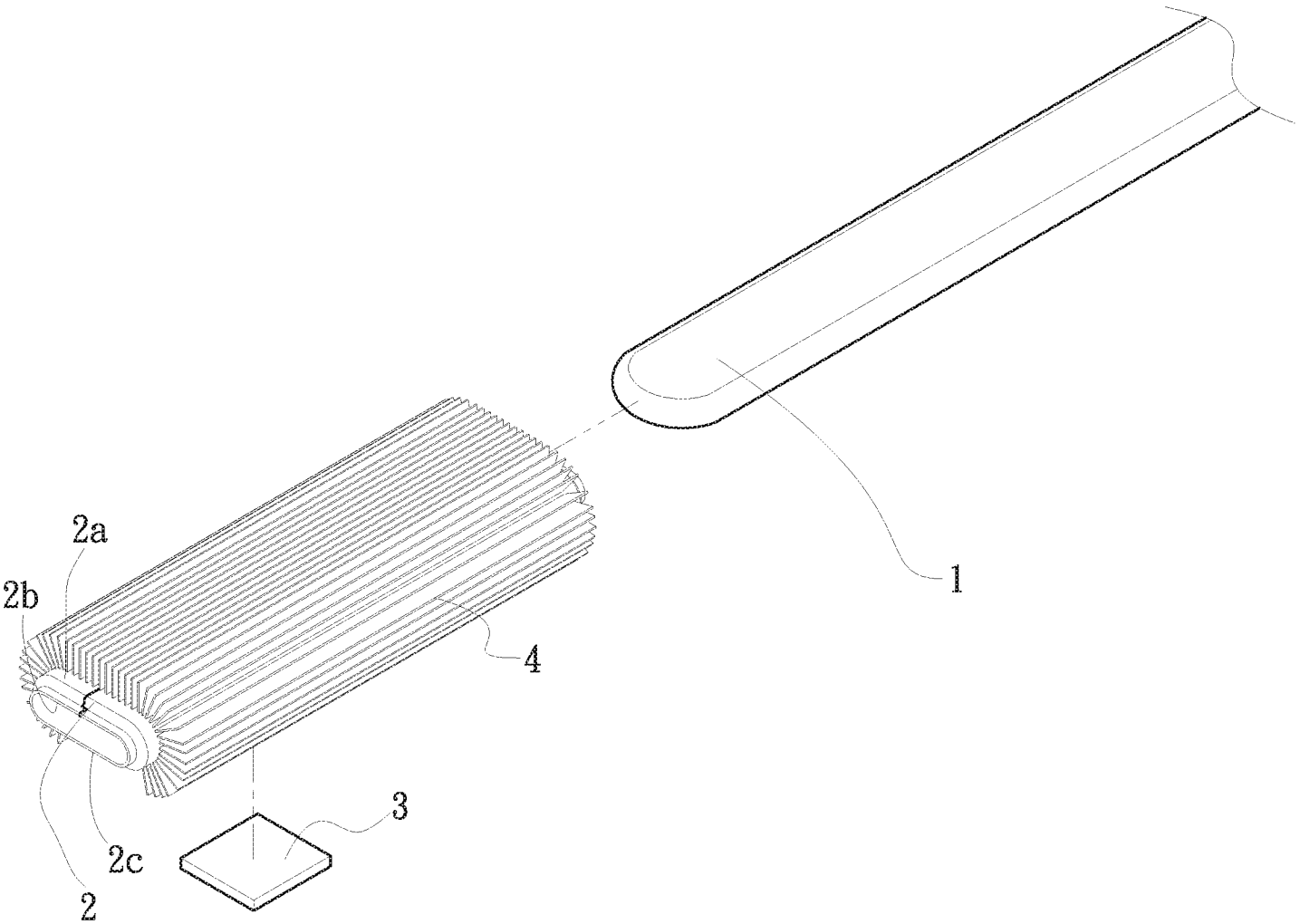
FIG. 3 is an exploded perspective view of the second embodiment of the dual heat transfer structure of the present invention.

Referring to FIG. 3, it is an exploded perspective view of the second embodiment of the dual heat transfer structure of the present invention. As shown, some structures of this embodiment are the same as the above-mentioned first embodiment, and here are not described again. The difference between this embodiment and the first embodiment is that the first side 2*a* of the vapor chamber 2 is provided with at least a heat absorbing portion 2*c* that is in contact with at least a heat source 3 and transfers heat, which is not limited. In other embodiments, the first side 2*a* is provided with multiple heat absorbing portions 2*c* that are in contact with multiple heat sources 3 and transfer heat.

In addition, a plurality of cooling fins 4 for increasing heat transfer efficiency is disposed on the rest portion of the heat absorbing portion 2*c* on the first side 2*a* of the vapor chamber 2 that is not in contact with the heat source 3. The second side 2*b* compasses, encircles, encloses, or surrounds the outer perimeter of the heat pipe 1 in an attaching manner, which conforms and is in contact with at least a portion of the heat pipe 1, and transfers heat.

Figure 4:
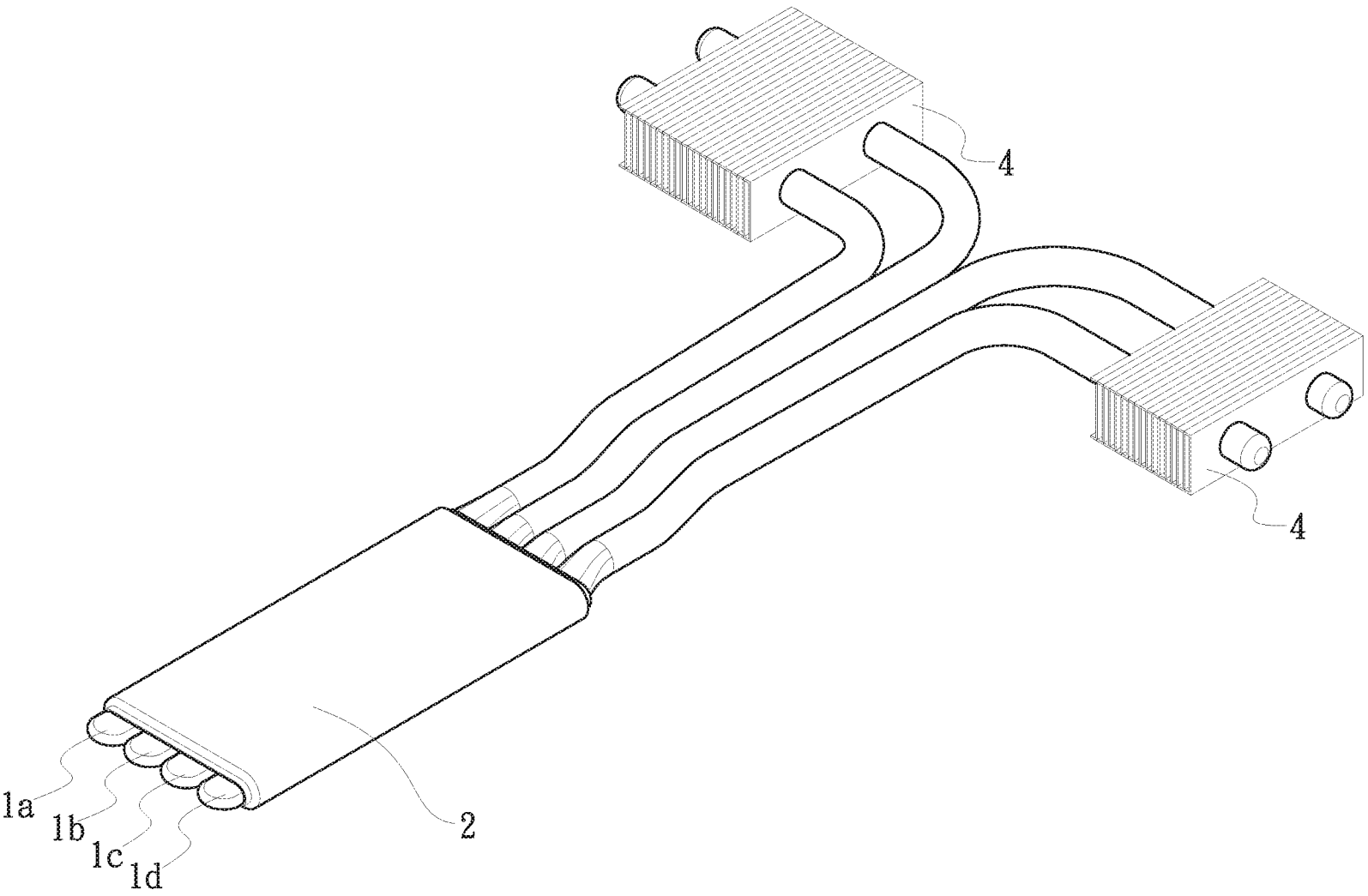
FIG. 4 is a perspective view of the third embodiment of the dual heat transfer structure of the present invention.

Referring to FIG. 4, it is a perspective view of the third embodiment of the dual heat transfer structure of the present invention. As shown, some structures of this embodiment are the same as the above-mentioned first embodiment, and here are not described again. The difference between this embodiment and the first embodiment is that this embodiment includes a first heat pipe 1*a*, a second heat pipe 1*b*, a third heat pipe 1*c*, and a fourth heat pipe 1*d*, which are disposed side by side horizontally (they can be disposed side by side vertically in other embodiments). The vapor chamber 2 compasses, encircles, encloses, or surrounds all the outer perimeters of the first, second, third, and fourth heat pipes 1*a*, 1*b*, 1*c*, 1*d*. Furthermore, one ends of the first, second, third, and fourth heat pipes 1*a*, 1*b*, 1*c*, 1*d*, which are in contact with the vapor chamber 2, are flat oval shaped (or in the shape of other geometries in other embodiments), while the other ends of the first, second, third, and fourth heat pipes 1*a*, 1*b*, 1*c*, 1*d*, which are not in contact with the vapor chamber 2, extend and pass through a plurality of cooling fins 4. Therefore, heat can be rapidly transferred to the distal end of each cooling fin.

Figure 5:
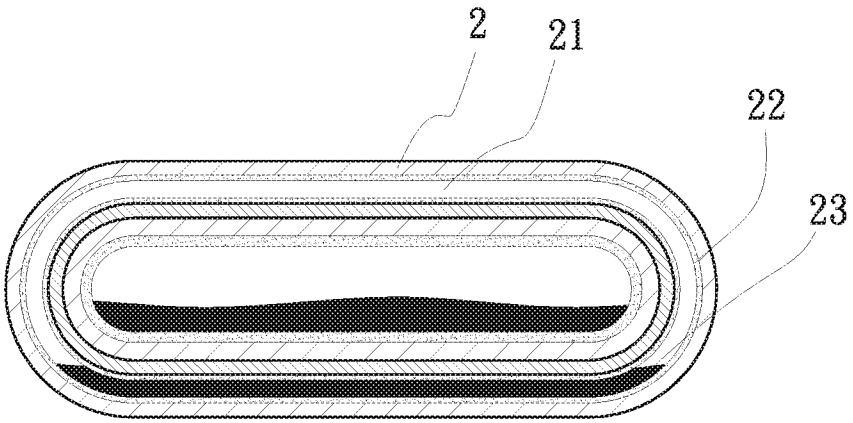
FIG. 5 is a side cross-sectional view of the fourth embodiment of the dual heat transfer structure of the present invention.

Referring to FIG. 5, it is a side cross-sectional view of the fourth embodiment of the dual heat transfer structure of the present invention. As shown, some structures of this embodiment are the same as the above-mentioned first embodiment, and here are not described again. The difference between this embodiment and the first embodiment is that the vapor chamber 2 in this embodiment is flat tubular shaped with its two ends being joined together, i.e., both the airtight chamber 21 and capillary wick 22 are a continuum structure within the vapor chamber, which allows the vapor-liquid flow inside the vapor chamber 2 to flow along the airtight chamber without interruption.

Figure 6:
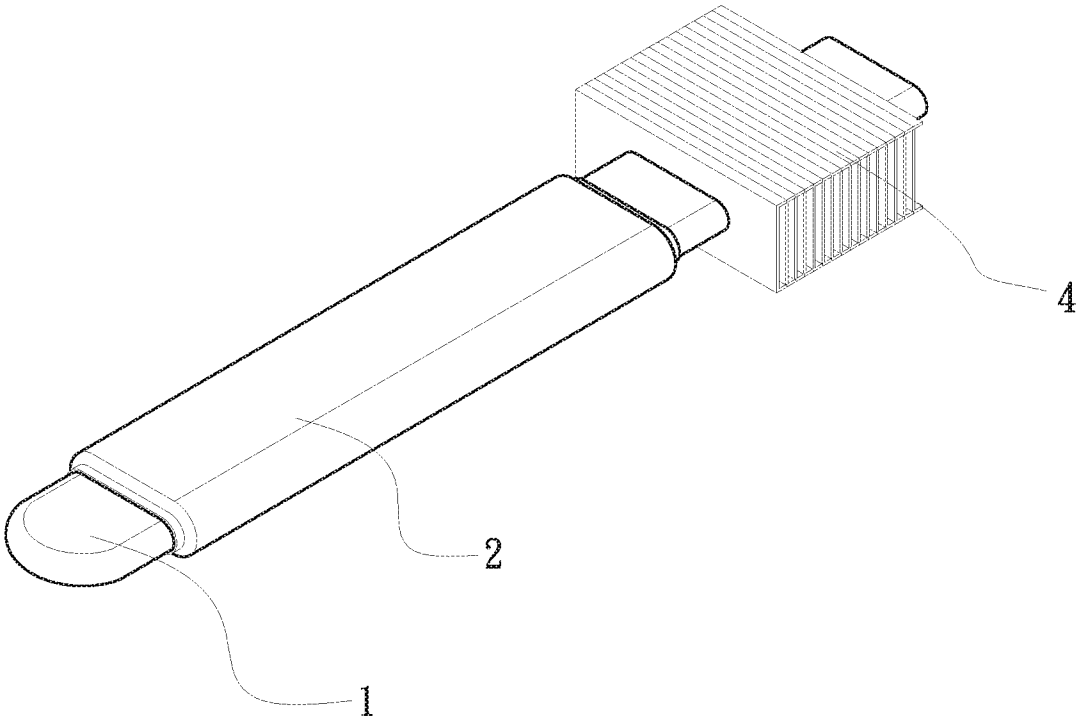
FIG. 6 is a perspective view of the fifth embodiment of the dual heat transfer structure of the present invention.

Referring to FIG. 6, it is a perspective view of the fifth embodiment of the dual heat transfer structure of the present invention. As shown, some structures of this embodiment are the same as the above-mentioned first embodiment, and here are not described again. The differences between this embodiment and the first embodiment are that the heat pipe 1 in this embodiment is a planner heat pipe, and the outer perimeter of one end of the heat pipe 1 is compassed by the vapor chamber 2 while the other end of the heat pipe 1 is connected with a plurality of cooling fins 4. The use of the cooling fins 4 in this embodiment is illustrative and not limiting, and in other embodiments the cooling fins can be a heat sink, liquid-cooling module, or radiator that rapidly transfers heat to the distal end of the structure.

Figure 7:
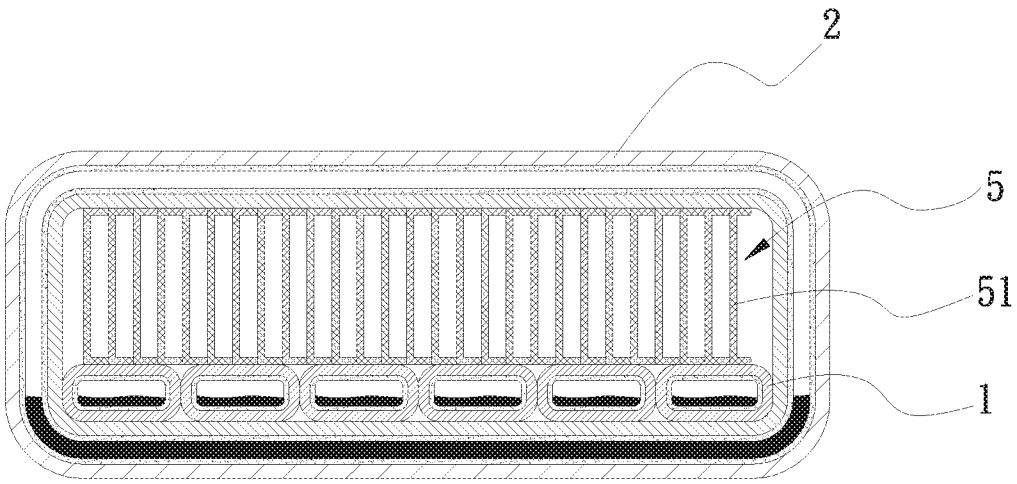
FIG. 7 is a schematic diagram of the sixth embodiment of the dual heat transfer structure of the present invention.

Referring to FIG. 7, it is a schematic diagram of the sixth embodiment of the dual heat transfer structure of the present invention. As shown, some structures of this embodiment are the same as the above-mentioned first embodiment, and here are not described again. The difference between this embodiment and the first embodiment is that a first heat sink 5, which contains a plurality of cooling fins 51, is disposed between the vapor chamber 2 and the heat pipe 1 and the vapor chamber 2 compasses both one sides of the first heat sink 5 and heat pipe 1.

After the vapor chamber 2 is concavely bent with its two ends being joined together, the plurality of heat pipes 1 and the first heat sink 5 (cooling fins) are arranged in a horizontal manner with the first heat sink 5 being disposed above the heat pipes 1, and the vapor chamber 2 encircles and compasses the heat pipes 1 and the first heat sink 5.

Figure 8:
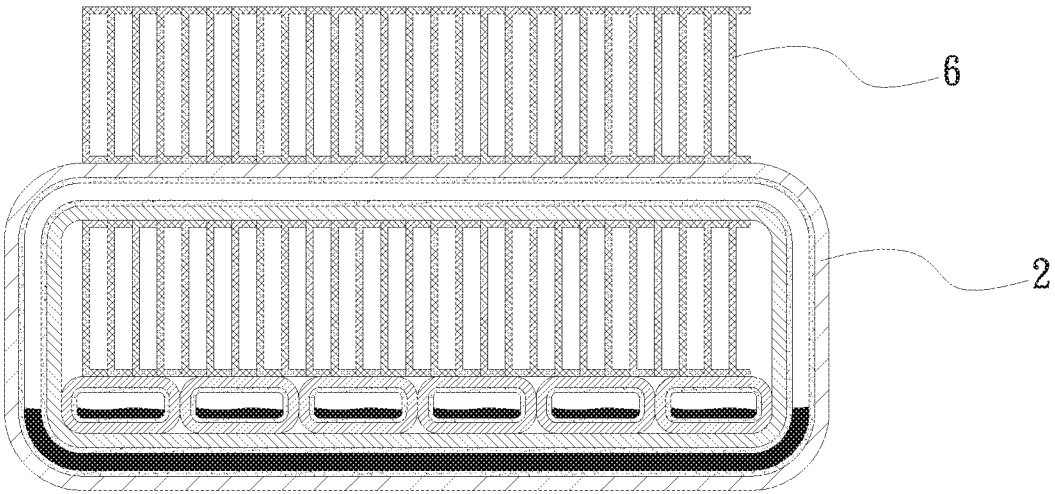
FIG. 8 is a schematic diagram of the seventh embodiment of the dual heat transfer structure of the present invention.

Referring to FIG. 8, it is a schematic diagram of the seventh embodiment of the dual heat transfer structure of the present invention. As shown, some structures of this embodiment are the same as the above-mentioned sixth embodiment, and here are not described again. The difference between this embodiment and the sixth embodiment is that a second heat sink 6 (cooling fins) is further disposed on one side of the outer surface of the vapor chamber 2 in this embodiment.

The cross sections of the first and second ends 11, 13 of the heat pipe 1 in each previously described embodiment are flat oval shaped (or oval or rectangular in shape in other embodiments) so that the heat pipe is able to be smoothly attached with the vapor chamber 2 or a cooling unit, thereby providing a larger contact area therebetween. And, the cross section of the remaining portion (i.e., the extending portion) of the heat pipe 1 can be an arbitrary shape or has a cross-sectional area larger than that of the first and second ends 11, 13 in order to increase the expansion efficiency of the vapor-liquid flow. In addition, the capillary wick 22 or 15 can be sintered powders, a mesh structure, woven structure, fiber structure, trenches, or the combination thereof and can be arranged in a single layer, multiple layers. It should be noted that the capillary wick in the embodiments being a single layer is illustrative and not limiting.

The design of the present invention that a vapor chamber compasses, encircles, encloses, or surrounds and attaches to a heat pipe (pipes) can transfer heat with a large area and to the distal end of the structure. Because the vapor chamber, which is in contact with one or more heat sources, compasses the outer perimeters of the heat pipe and heat sink, heat can be absorbed from the heat sources, and transferred in a large area to the surface in one end of the heat pipe and to the heat sink simultaneously by the vapor chamber. After one end of the heat pipe and the heat sink (cooling fins) receive the heat transferred via the vapor chamber, the heat is transferred to the distal end of the structure and dissipated. Also, the heat sink (cooling fins) is capable of dissipating heat in a short period of time, thus preventing heat from accumulating. Therefore, heat transfer efficiency can be significantly improved.

What is claimed is:

1. A dual heat transfer structure comprising:

at least a heat pipe having a first end, an extension portion, and a second end, the first and second ends disposed at two ends of the extension portion and a vapor chamber concavely bent with two opposed edges of the vapor chamber each defining mating lip sides which are joined together such that the vapor chamber encircles one of the first end, the second end, and the extension portion.

2. The dual heat transfer structure of claim 1, wherein the vapor chamber is provided with an airtight chamber, a wall, a capillary wick, and a working fluid filled inside the airtight chamber, and wherein the vapor chamber has a first side and a second side, wherein the second side is arranged on an inner surface of the vapor chamber after the vapor chamber is concavely bent and attached to an outer perimeter of the heat pipe.

3. The dual heat transfer structure of claim 2, wherein the first side of the vapor chamber is a heat absorbing side in contact with at least a heat source to transfer heat, the second side is a heat dissipating side to transfer heat to the heat pipe attached therewith, and further comprising a plurality of cooling fins disposed on a remainder portion of the first side that is not in contact with the heat source.

4. The dual heat transfer structure of claim 1, wherein the heat pipe is provided with a vacuum chamber.

5. The dual heat transfer structure of claim 1, wherein the first end and the second end of the heat pipe are flat oval shaped, oval, or rectangular in shape.

* * * * *